US007006665B2

(12) United States Patent
Olson et al.

(10) Patent No.: US 7,006,665 B2
(45) Date of Patent: Feb. 28, 2006

(54) ADAPTIVE, PRODUCT CONTROL AND STABILIZATION SUB-SYSTEM FOR CAMERA-BASED OPTICAL CHARACTER RECOGNITION, AND A METHOD OF OPERATING THE SAME

(75) Inventors: Jack E. Olson, Tulsa, OK (US); Joe C. Bollinger, Tulsa, OK (US); Willson L. Mayerberg II, Skiatook, OK (US); William Wheeler, Sand Springs, OK (US)

(73) Assignee: Lockheed Martin Corporation, Bethesda, MD (US)

( * ) Notice: Subject to any disclaimer, the term of this patent is extended or adjusted under 35 U.S.C. 154(b) by 626 days.

(21) Appl. No.: 10/050,784

(22) Filed: Jan. 18, 2002

(65) Prior Publication Data

US 2003/0138129 A1 Jul. 24, 2003

(51) Int. Cl.
*G06K 9/00* (2006.01)

(52) U.S. Cl. ..... 382/101; 209/24; 705/406

(58) Field of Classification Search ..... 382/101, 382/100, 321; 209/24, 28, 134, 378, 584, 209/900; 705/406, 198, 401; 414/676; 198/428, 198/460.1; 406/11
See application file for complete search history.

(56) References Cited

U.S. PATENT DOCUMENTS 5,363,967 A * 11/1994 Tilles et al. ..... 209/539
5,465,828 A * 11/1995 Thomas et al. ..... 198/495
5,508,818 A 4/1996 Hamma
5,629,988 A 5/1997 Burt et al.
5,765,749 A * 6/1998 Harper ..... 232/17
5,774,592 A 6/1998 Takeuchi et al.
5,790,709 A 8/1998 Kopeika et al.
5,829,577 A * 11/1998 Grisley ..... 198/811
5,957,306 A * 9/1999 Hoffman ..... 209/587
6,097,832 A 8/2000 Guillotel et al.
6,108,032 A 8/2000 Hoagland
6,122,320 A 9/2000 Bellifemine et al.
6,435,331 B1 * 8/2002 Olson et al. ..... 198/357
6,685,401 B1 * 2/2004 de Almeida Rodrigues et al. ..... 406/11
6,752,261 B1 * 6/2004 Gaeddert et al. ..... 198/861.1
6,808,358 B1 * 10/2004 Mayerberg et al. ..... 414/676
6,843,367 B1 * 1/2005 Gentile et al. ..... 198/861.1
2002/0134712 A1 * 9/2002 DeWitt et al. ..... 209/584
2002/0192038 A1 * 12/2002 Trenel et al. ..... 406/88

(Continued)

*Primary Examiner*—Barry Choobin
(74) *Attorney, Agent, or Firm*—Schwartz & Weinrieb

(57) ABSTRACT

A mail article transportation and stabilization system, and a method of operating the same, for use in conjunction with a camera-based optical character recognition (OCR), bar code reader (BCR), or similar image capture scanning system, comprises a conveyor drive belt for conveying the articles, pieces, or units of mail across a platen assembly within which an optical character recognition (OCR), bar code reader (BCR), or similar image capture camera or the like is positioned and in conjunction with which there is provided a serial array of air plenums for effectively creating an air bearing or air layer upon which the conveyor belt and the articles, pieces, or units of mail are conveyed in a relatively frictionless manner. The incoming pieces, articles, or units of mail are therefore able to be conveyed in a smooth, jitter-free, and stabilized manner whereby scanning, imaging, and reading of the address information contained upon the articles, pieces, or units of mail, as the articles, pieces or units of mail are conveyed past the camera view port, are able to be accurately, clearly, and completely achieved.

20 Claims, 2 Drawing Sheets

U.S. PATENT DOCUMENTS

2003/0012407 A1 * 1/2003 Rosenbaum et al. ..... 382/101
2003/0137101 A1 * 7/2003 Hendzel ..... 271/272
2003/0145664 A1 * 8/2003 Schwarz et al. ..... 73/863.22
2004/0050664 A1 * 3/2004 Flom ..... 198/460.1
2004/0118663 A1 * 6/2004 Gaeddert et al. ..... 198/861.1
2004/0251606 A1 * 12/2004 Mayerberg et al. ..... 271/197

* cited by examiner

ADAPTIVE, PRODUCT CONTROL AND STABILIZATION SUB-SYSTEM FOR CAMERA-BASED OPTICAL CHARACTER RECOGNITION, AND A METHOD OF OPERATING THE SAME

FIELD OF THE INVENTION

The present invention relates generally to mail article transportation systems, and a method of operating the same, and more particularly to a new and improved mail article transportation and stabilization system for use in conjunction with camera-based optical character recognition (OCR), bar code reader (BCR), or other image capture scanning systems in order to improve the capability of the system to quickly and accurately read address information whereby, in turn, mail pieces, articles, or units can be quickly and accurately sorted, handled, and distributed in accordance with desirable automatic processing and sequence-address delivery of mail to recipients.

BACKGROUND OF THE INVENTION

In view of current commercial requirements or conditions, as well as competitive business pressures, automated mail processing scanning or reading, sorting, handling, and distributing systems are required to accommodate and process an ever-increasing range of individually diverse mail products, pieces, articles, or units. In accordance with an initial processing step or stage of the aforenoted overall automated mail processing system, the system must physically transport and present the various articles, pieces, or units of mail to an optical character recognition (OCR), a bar code reader (BCR), or an equivalent image capture, camera sub-system such that address recognition can be quickly and accurately achieved or accomplished. Conventional mail piece or article transportation or conveyance systems, however, have exhibited or experienced several operational problems which effectively prohibit or militate against the successful achievement or accomplishment of the necessary address recognition processing operation.

More particularly, in accordance with such conventional mail piece or article transportation or conveyance systems, mail pieces or articles are conveyed through the camera sub-system and across the slotted reader platen as a result of being tightly pressed or sandwiched between a roller-backed and conveyed transport or conveyor belt and a stainless steel reader platen. A critical consideration in connection with the quick and accurate achievement or accomplishment of the address recognition processing of the mail pieces or articles comprises the conveyance or transportation of the mail pieces or articles in a vibration-free or jitter-free operational mode because if the mail pieces or articles are in fact subjected to vibrations, jitter, extraneous shock forces, or the like, the images of such mail pieces or articles, as captured by means of the camera sub-system, will not be clear, focused, complete, or accurate. Unfortunately, however, the aforenoted type of conventional conveyor or transport system is incapable of transporting or conveying the mail pieces or articles in such a desirable jitter-free or vibration-free operational mode. The reasons for these results reside in, or derive from, basic structural characteristics of the transportation or conveyor system.

More specifically, the presence or disposition of the roller mechanisms along the actual transport or conveyor belt flow path, and at positions opposite, or within the immediate vicinity of, the slotted reader platen comprising the camera view-port, causes the mail pieces or articles to sometimes be conveyed or transported in a substantially or somewhat undulated manner. This is partly due to the fact that during cyclical conveyor belt transportation or conveyance by means of the conveyor rollers, the latter undergo compression and decompression movements with respect to the stainless steel platen which effectively provides or exhibits a predetermined amount of resistance to the movements of the roller mechanisms. However, within the immediate area or vicinity of the slotted camera view-port, the view-port does not provide the same level of predetermined resistance to the movements of the roller mechanisms as does the stainless steel platen. Accordingly, the conveyor roller mechanisms, acting through means of the conveyor belt, can cause the mail pieces or articles to be forced or depressed into the view-port region of the platen assembly. In turn, such physical depression of the mail pieces or articles causes the lineal surface dimensions of the mail pieces or articles to be increased thereby resulting in skewed imagery and imaging results. Still yet further, the decompression and compression of the backup roller mechanisms cause lineal portions of the conveyor belt to be stretched or relaxed which effectively causes images to be stretched or compressed, or even missed, as the mail articles or pieces move beyond the camera scan line. In addition, the disposition of a lineal conveyor belt over a planar platen results in the generation of considerable drag forces to be impressed upon the mail pieces, articles, or products. In view of all of the foregoing operational characteristics or factors, the camera receives skewed, smeared or incomplete images which of course, in turn, lead to reader system failures.

A need therefore exists in the art for a new and improved product adaptive, control and stabilization article conveyor or transport sub-system for use in connection with a camera-based optical character recognition (OCR), bar code reader (BCR), or similar image capture system wherein the components of the system do not exhibit or generate the aforenoted pressure and drag-induced destabilizing forces characteristic of conventional or PRIOR ART mail piece or article camera imaging systems such that the resulting imagery is not skewed, smeared, compressed, or incomplete, and is therefore, in turn, clear, accurate, and complete so as not to result in reader system failures.

OBJECTS OF THE INVENTION

Accordingly, it is an object of the present invention to provide a new and improved mail article transportation and stabilization system, and a method of operating the same, for use in conjunction with camera-based optical character recognition (OCR), bar code reader (BCR), or other image capture scanning systems in order to improve the capability of the system to quickly and accurately read mail address information.

Another object of the present invention is to provide a new and improved mail article transportation and stabilization system, and a method of operating the same, for use in conjunction with camera-based optical character recognition (OCR), bar code reader (BCR), or similar image capture scanning systems which is capable of improving the capability of the system to quickly and accurately read mail address information such that conventional operational draw-backs characteristic of PRIOR ART mail transportation or conveyor systems are effectively overcome.

An additional object of the present invention is to provide a new and improved mail article transportation and stabilization system, and a method for operating the same, for use in conjunction with camera-based optical character recognition (OCR), bar code reader (BCR), or similar image capture scanning systems which is capable of transporting and conveying mail pieces, articles, or units in a jitter-free stabilized mode.

A further object of the present invention is to provide a new and improved mail article transportation and stabilization system, and a method of operating the same, for use in conjunction with camera-based optical character recognition (OCR), bar code reader (BCR), or similar image capture scanning systems which is capable of transporting and conveying mail pieces, articles, or units in a jitter-free stabilized mode so as to improve the capability of the system to quickly and accurately read mail address information.

A last object of the present invention is to provide a new and improved mail article transportation and stabilization system, and a method of operating the same, for use in conjunction with camera-based optical character recognition (OCR), bar code reader (BCR), or similar image capture scanning systems which is capable of transporting and conveying mail pieces, articles, or units in a jitter-free stabilized mode such that the resulting imagery is not skewed, smeared, compressed, or incomplete whereby the capability of the system to quickly and accurately read mail address information is vastly improved.

SUMMARY OF THE INVENTION

The foregoing and other objectives are achieved in accordance with the teachings and principles of the present invention through the provision of a new and improved mail article transportation and stabilization system, and a method of operating the same, for use in conjunction with a camera-based optical character recognition (OCR), bar code reader (BCR), or similar image capture scanning system wherein the system comprises a platen assembly within which an optical character recognition (OCR), bar code reader (BCR), or similar image capture camera, or the like component, is positioned.

The optical character recognition (OCR), bar code reader (BCR), or similar image capture camera, or the like component, is provided with a view port across which mail units, pieces, or articles are transported and conveyed by means of an inner run section of a conveyor belt which is disposed directly opposite the platen assembly, and the platen assembly is further provided with a serial array of air plenums, as considered in the article transport or conveyance direction, from which low-pressure air streams are discharged or supplied. The low-pressure air streams serve not only to effectively cause the incoming pieces, articles, or units of mail to be forced into engagement with the inner run section of the conveyor belt, whereby the articles of mail will adhere to and be subsequently conveyed by the conveyor belt as a result of the coefficient of friction established therebetween, but in addition, the low-pressure air streams also effectively establish an air bearing upon which the articles of mail, as well as those portions of the conveyor belt which do not have articles of mail disposed thereon, are able to be conveyed in a smooth, jitter-free, and stabilized manner. Accordingly, scanning, imaging, and reading of the address information data contained upon the articles, pieces, or units of mail, as they are conveyed past the camera view port, are able to be clearly, accurately, and completely achieved.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
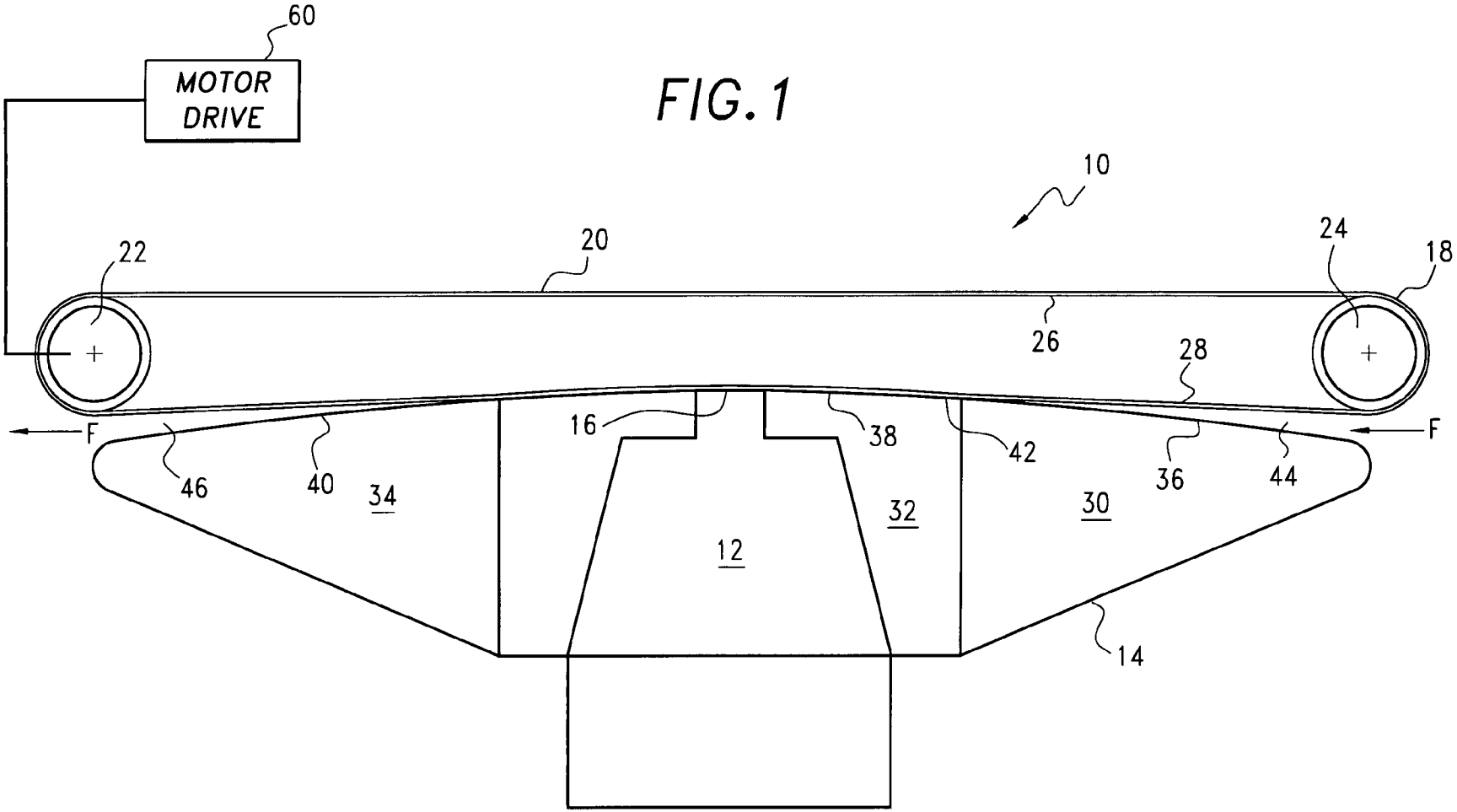
FIG. 1 is a top plan view of a new and improved mail article transportation and stabilization system for use in conjunction with a camera-based optical character recognition (OCR), bar code reader (BCR), or similar image capture scanning system constructed in accordance with the principles and teachings of the present invention and showing the cooperative parts thereof.
Figure 2:
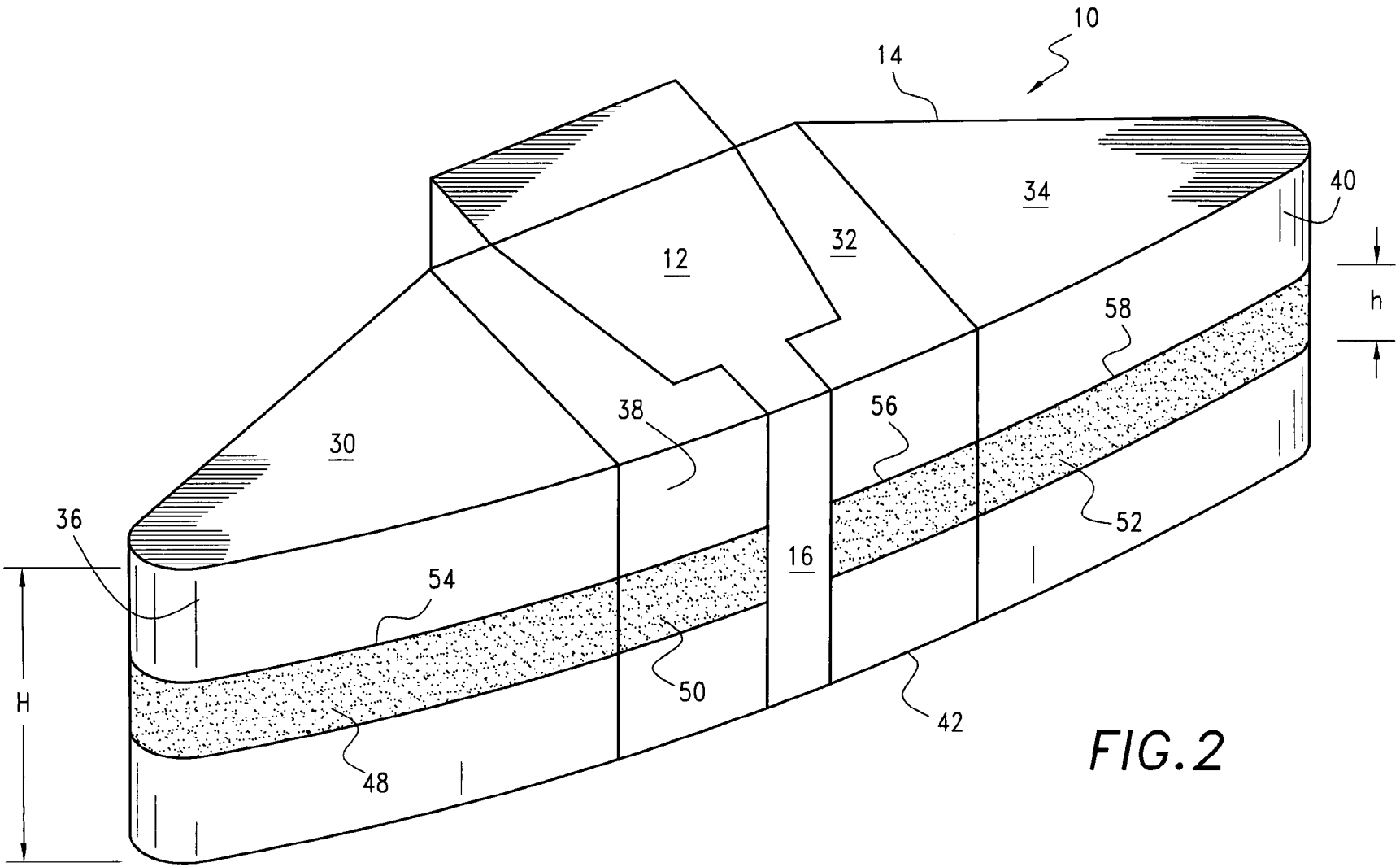
FIG. 2 is a front perspective view of the air plenum and optical character recognition (OCR), bar code reader (BCR), or similar image capture camera, or like component, scanning assembly system utilized within the overall mail article transportation and stabilization system illustrated within FIG. 1.

Referring now to the drawings, and more particularly to FIGS. 1 and 2 thereof, a new and improved mail article transportation and stabilization system, for use in conjunction with a camera-based optical character recognition (OCR), bar code reader (BCR), or similar image capture indicia or address information scanning system, is disclosed and is generally indicated by the reference character 10. It is initially to be noted and understood that in connection with the use of the term "mail" within this patent application, and in conjunction with the particular system and method of operating the same as disclosed, such term encompasses letter mail, flats, folded sheets of paper, and the like. More particularly, the new and improved flat mail article transportation and stabilization system 10 comprises an optical character recognition (OCR), bar code reader (BCR), or similar image capture camera or the like 12 which is mounted within a housing 14 and which is provided with a view port 16. The view port 16 has a predetermined vertical extent and is disposed within a vertical plane which is effectively perpendicular to the direction F in which the articles, pieces, or units of mail are normally conveyed by means of a conveyor belt-type conveyor system 18. As has been noted hereinbefore, in accordance with the principles and teachings of the present invention, it is critically important, in connection with the achievement of clear, accurate, and complete scanning, imaging, and reading of the various indicia or address information as contained upon the individual articles, pieces, or units of mail that are being conveyed by means of the conveyor-belt transportation system 18 past the view port 16 of the optical character recognition (OCR), bar code reader (BCR), or similar image capture camera or the like 12, that the various articles, pieces or units of mail are in fact conveyed past the view port 16 of the optical character recognition (OCR) or bar code reader (BCR) camera 12 in a stable and jitter-free manner.

Accordingly, it is noted that conveyor belt system 18 comprises a conveyor belt 20 which is routed around first and second conveyor rollers 22, 24, at least one of which comprises a drive roller, and it is seen that the conveyor belt 20 comprises an outer run section 26 and an inner run section 28. It is further noted that the housing 14, within which the optical character recognition (OCR), bar code reader (BCR), or similar image capture camera or the like 12 is mounted, has a predetermined longitudinal extent, as considered in the direction F in which the various articles, pieces, or units of mail are being conveyed, and that the conveyor rollers 22,24 are disposed or positioned at the longitudinal extremes or ends of the housing 14. In this manner, it can be readily appreciated that no conveyor system rollers, or other operative conveyor system hardware, other than the inner run section 28 of the conveyor belt 20, is disposed within the vicinity of, or in direct contact with, the housing 14 so as not to cause, or result in, any deleterious effects to be impressed upon the various articles, pieces, or units of mail as the same are being conveyed along the front face of the housing 14 and past the view port 16 of the optical character recognition (OCR), bar code reader (BCR), or similar image capture camera or the like 12. Consequently, the various articles, pieces or units of mail are in fact able to be conveyed past the view port 16 of the optical character recognition (OCR),bar code reader (BCR), or similar image capture camera or the like 12 in a stable and jitter-free manner whereby clear, accurate, and complete scanning, imaging, and reading of the various indicia or address information, as contained upon the individual articles, pieces, or units of mail that are being conveyed past the view port 16 of the optical character recognition (OCR), bar code reader (BCR), or similar image capture camera or the like 12, is in fact able to be achieved.

In order to achieve the aforenoted conveyance of the various articles, pieces or units of mail past the view port 16 of the optical character recognition (OCR), bar code reader (BCR), or similar image capture camera or the like 12 in a stable and jitter-free manner, it is further noted that the housing 14 is divided into a plurality of air plenum sections 30,32,34, and that the front face 36,38,40 of each one of the air plenum sections 30,32,34 of the housing 14 define a continuum 42 which has a substantially arcuate configuration with the arcuate-defining locus of the front face continuum 42 being disposed, for example, upon a forty-two inch (42.00") radius. It can therefore be readily appreciated that the front face 36 of the right air plenum section 30, as considered or viewed in FIG. 1, effectively diverges away from the plane normally defined by means of the inner run section 28 of the conveyor belt 20 such that a first space 44 is defined between the front face 36 of the air plenum section 30 and a right end portion of the inner run section 28 of the conveyor belt 20 so as to serve as a mail entrance slot into which the incoming mail articles, pieces, or units are able to be conveyed. In a similar manner, the front face 40 of the left air plenum section 34, as also considered or viewed in FIG. 1, also diverges away from the plane normally defined by means of the inner run section 28 of the conveyor belt 20 such that a second space 46 is defined between the front face 40 of the air plenum section 34 and a left end portion of the inner run section 28 of the conveyor belt 20 so as to serve as a mail discharge slot into which the outgoing mail articles, pieces, or units are able to be conveyed. Lastly, it is noted that a central portion of the inner run section 28 of the conveyor belt 20 is effectively disposed in contact with the front face portion 38 of the central air plenum section 32 whereby the central portion of the inner run section 28 of the conveyor belt 20 is effectively conveyed along an arcuate flow path and across the camera view port 16.

In accordance with a unique and novel structural feature characteristic of the present invention, and as best appreciated from FIG. 2, each one of the front face portions 36,38,40 of the air plenum sections 30,32,34 is fabricated from stainless steel, and each one of the front face portions 36,38,40 of the air plenum sections 30,32,34 is also respectively provided with a series of holes or apertures 48,50,52 from which air streams, characterized by means of predetermined pressure levels, are discharged. More particularly, the air plenum housing 14 has a predetermined height dimension H which may be, for example, approximately ten inches (10.00"), and it is seen that the apertures 48,50,52 are defined within horizontally disposed strip portions 54, 56,58 which respectively have substantially smaller height dimensions h which may be, for example, only a fractional portion of the over-all height dimension H of the housing 14 and in particular may be on the order of two inches (2.00"). The pressurized air disposed within the longitudinally separated air plenum sections 30,34 is characterized by means of a pressure level on the order of two inches (2.00") of water whereas the pressurized air disposed within the central air plenum section 32 is characterized by means of a pressure level on the order of one inch (1.00") of water. Consequently, substantially low pressure air streams are continually discharged from each one of the front face portions 36,38,40 of the air plenum sections 30,32,34 toward and into contact with the inner run section 28 of the conveyor belt 20.

In operation, eddy current air streams are discharged from and interposed between the front face portions 36,38,40 of the air plenum sections 30,32,34 as a result of the internal pressurization of the air within the air plenum sections 30,32,34, as well as the air being effectively entrained by means of the inner run section 28 of the conveyor belt 20 as the conveyor belt 20 is driven by means of the conveyor belt drive system, not shown, operatively connected to at least one of the conveyor belt rollers 22,24. It is therefore to be appreciated that such eddy current air streams effectively define an air bearing system between each one of the air plenum sections 30,32,34 of the air plenum housing 14 and the inner run section 28 of the conveyor belt 20. In particular, when no articles, pieces, or units of mail are being conveyed by means of the conveyor belt 20, the low pressure air stream issuing from the apertures 50 of the central air plenum section 32 causes the central portion of the inner run section 28 of the conveyor belt 20 to in effect be levitated with respect to the front face portion 38 of the air plenum section 32 such that the inner run section 28 of the conveyor belt 20 is conveyed past the front face portion 38 of the air plenum section 32 in a substantially frictionless manner as a result of being conveyed upon the air bearing or air layer defined by such air stream. This disposition of the inner run section 28 of the conveyor belt 20 upon the air bearing or air layer defined by such air stream, and with respect to the central air plenum section 32, is critically important in that no frictional or drag forces are impressed upon the conveyor belt 20, and in addition, the service life of the conveyor belt 20 is enhanced.

When articles, pieces, or units of mail are being conveyed, for example, in a ballistic fashion by means of a conveyor belt, not shown, disposed upstream of the conveyor belt 20 such that the articles, pieces, or units of mail serially enter the mail entrance slot 44 defined between the front face portion 36 of the right air plenum section 30 and the right end portion of the inner run section 28 of the conveyor belt 20, the low pressure air stream issuing from the apertures 48 of the right air plenum section 30 causes the articles, pieces, or units of mail to likewise be levitated or pneumatically conducted toward and into engagement with the inner run section 28 of the conveyor belt 20. It is noted that the arcuate configuration of the front face of the housing 14 defining the continuum 42, and in particular, the arcuate configuration of the front face portion 36 of the right air plenum section 30, not only serves to define the aforenoted mail entrance slot 44, but in addition, permits the air stream issuing from apertures 48 of right air plenum section 30 to engage the oncoming downstream end portion of the particular article, piece, or unit of mail and interact with the same in a substantially aerodynamic manner thereby effectively lifting the same and causing such article, piece, or unit of mail to be deposited onto the inner run section 28 of the conveyor belt 20. Once the particular article, piece, or unit of mail is deposited upon the inner run section 28 of the conveyor belt 20, the coefficient of friction characteristic of the conveyor belt 20 will be sufficient to maintain the article, piece, or unit of mail upon the conveyor belt 20 such that the article, piece, or unit of mail may subsequently be conveyed downstream across the view port 16 of the optical character recognition (OCR), bar code reader (BCR), or similar image capture camera or the like 12 whereby the particular address indicia or information printed upon the particular article, piece, or unit of mail can be scanned, imaged, and read.

Still further, it is also to be appreciated that the air streams issuing from the apertures 50 of the strip portion 56 of the central air plenum section 32 always serve to establish an air bearing or air layer between the view port 16 of the optical character recognition (OCR), bar code reader (BCR), or similar image capture camera or the like 12 and the inner run section 28 of the conveyor belt 20, as well as with respect to any articles, pieces, or units of mail being conveyed thereby, so as to effectively levitate the conveyor belt 20 and any articles, pieces, or units of mail being conveyed thereby such that the conveyor belt 20 and any articles, pieces, or units of mail being conveyed thereby are in fact able to be conveyed in a frictionless stabilized manner. In addition to the establishment of the aforenoted air bearing system, it is noted still further, in conjunction with the structure and objectives of the present invention, that the absence of any hardware components of the conveyor belt system, other than the inner run section 28 of the conveyor belt 20, within the vicinity of, and in contact or engagement with, the plenum housing 14 and the optical character recognition (OCR), bar code reader (BCR), or similar image capture camera or the like 12 contained therein, likewise facilitates the conveyance of the articles, pieces, or units of mail in a jitter-free and stabilized manner past the camera view port 16.

It is still further noted that in view of the fact that only the inner run section 28 of the conveyor belt 20 is disposed in contact with the central air plenum section 32 and the view port 16 of the optical character recognition (OCR), bar code reader (BCR), or similar image capture camera or the like 12, deflection of the inner run section 28 of the conveyor belt 20 away from the view port 16 will be readily permitted even when a particular article, piece, or unit of mail has a particular thickness dimension which is relatively larger than corresponding thickness dimensions of other articles, pieces, or units of mail. Accordingly, accurate, clear, and complete scanning, imaging, and reading of the various indicia or address information, as contained upon the individual units, articles, or pieces of mail that are being conveyed past the view port 16 of the optical character recognition (OCR), bar code reader (BCR), or similar image capture camera or the like 12, is in fact always able to be achieved.

In a similar manner, it is noted that the arcuate configuration of the front face portion 40 of the left air plenum section 34, as viewed in FIG. 1, not only serves to define the aforenoted mail discharge slot 46, but in addition, permits the air stream issuing from apertures 52 of left air plenum section 34 to engage the oncoming leading or downstream end portion of the particular article, piece, or unit of mail, as the same passes the view port 16 and is conveyed downstream, so as to interact with the same in a substantially aerodynamic manner thereby effectively lifting the same and causing such article, piece, or unit of mail to be maintained upon the inner run section 28 of the conveyor belt 20. This aerodynamic interaction between the air streams issuing from the apertures 52 of left air plenum section 34, as viewed in FIG. 1, and the articles, pieces, or units of mail being conveyed by the conveyor belt 20, is also critically important to the conveyance of the articles, pieces, or units of mail in a jitter-free and stabilized manner past the camera view port 16. The reason for this is that if the articles, pieces, or units of mail were not in effect stabilized by means of the air streams issuing from the apertures of left air plenum section 34, as viewed in FIG. 1, and were therefore permitted to otherwise encounter destabilizing factors or conditions, such destabilizing conditions or factors can be propagated backwardly in the upstream direction toward upstream portions of the articles, pieces, or units of mail still being scanned, imaged, and read thereby leading to unclear, inaccurate, and incomplete scanning, imaging, and reading of the various indicia or address information contained upon the individual articles, pieces, or units of mail.

It is to be additionally noted that, in connection with the discharge or issuance of the air streams from the apertures 48,50,52 formed within the air plenum sections 30,32,34, such air streams are able to interact with or upon the articles, pieces, or units of mail, and to effectively establish the air bearing or air layer, upon which the articles, pieces, or units of mail are able to be smoothly conveyed by means of the conveyor belt 20, in a positive or effective manner as a result of being effectively confined within zones which correspond to the vertical extents of the apertured strips or regions 54,56,58 defined within the front face portions 36,38,40 of the air plenum sections 30,32,34. This confinement of the air streams to the aforenoted zones is facilitated by the fact that the pressurized air issuing from the apertures 48,50,52 is characterized by relatively low pressure levels, such as, for example, one or two inches (1.00–2.00") of water. Since one psi of pressure equals almost twenty-eight inches (actually, 27.7") of water, and since atmospheric pressure is 14.7 psi, atmospheric pressure regions disposed or existing above and below the apertured strips or regions 54,56,58 are at substantially higher pressure levels and are therefore readily capable of confining the air streams issuing from the apertures 48,50,52 to within their zoned regions. The confinement of the air streams to within the aforenoted zoned regions therefore always ensures the presence of the air bearings or air layers upon which the articles, pieces, or units of mail are conveyed and supported.

As has been noted hereinbefore, the conveyor belt system 18 comprises a drive system wherein at least one of the conveyor belt rollers 22,24 comprises a drive roller, and in accordance with a last unique and novel feature characteristic feature of the present invention, and as best seen in FIG. 1, the conveyor belt system 18 comprises a drive motor 60 which is illustrated, for example, as being operatively connected to the conveyor roller 22 and which may be either a servo drive motor, a constant RPM speed drive motor, including an AC motor, or the like. The use of such drive mechanisms is critically important to the enhanced operation of the new and improved mail article transportation and stabilization system, for use in conjunction with the optical character recognition (OCR), bar code reader (BCR), or similar image capture indicia or address information scanning system or camera 12, in that such a drive motor permits the conveyor belt 20 to be driven in a smooth manner, without chatter, and in accordance with various operational modes which are or may be necessary in connection with the successful scanning, imaging, and reading of the indicia or address information contained upon the various articles, units, or pieces of mail.

Thus, it may be seen that in accordance with the principles and teachings of the present invention, there has been provided a new and improved mail article transportation and stabilization system for use in conjunction with a camera-based optical character recognition (OCR), bar code reader (BCR), or similar image capture scanning system wherein, as a result of the articles, pieces, or units of mail being transported and conveyed by means of the inner run section of the conveyor drive belt across a platen assembly within which an optical character recognition (OCR), bar code reader (BCR), or similar image capture camera or the like is positioned, and in conjunction with which there is provided a serial array of air plenums for effectively creating an air bearing or air layer upon which the conveyor belt and the articles, pieces, or units of mail are conveyed in a relatively frictionless manner, the incoming pieces, articles, or units of mail are able to be conveyed in a smooth, jitter-free, and stabilized manner. Accordingly, scanning, imaging, and reading of the address information data contained upon the articles, pieces, or units of mail, as the articles, pieces or units of mail are conveyed past the camera view port, are able to be clearly, accurately, and completely achieved.

From the foregoing, it can be appreciated that many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A mail article transportation and stabilization system, for use in conjunction with a camera-based scanning system whereby clear, accurate, and complete scanning, imaging, and reading of address information, contained upon a plurality of mail articles, can be achieved, comprising:

a housing comprising a front surface;

a camera fixedly disposed within said housing and comprising a camera view port defined within said front surface of said housing and across which a plurality of mail articles are to be serially conveyed;

a conveyor belt having a conveying surface for serially conveying the plurality of mail articles across said camera view port of said camera in a longitudinal direction such that information contained upon the plurality of mail articles can be scanned, imaged, and read by said camera; and air plenum means defined within said housing for generating air streams outwardly from said housing and toward said conveying surface of said conveyor belt, upon which the plurality of mail articles are being conveyed, so as to force the plurality of mail articles onto said conveying surface of said conveyor belt, and to define an air bearing layer upon which said conveyor belt, and the plurality of mail articles being conveyed by said conveyor belt, can be conveyed in a substantially smooth, frictionless, and jitter-free manner across said camera view port of said camera such that said camera can scan, image, and read the information contained upon the plurality of mail articles in an accurate, clear, and complete manner.

2. The system as set forth in claim 1, wherein:

said camera comprises an optical character recognition (OCR) type camera.

3. The system as set forth in claim 1, wherein:

said camera comprises a bar code reader (BCR) type camera.

4. The system as set forth in claim 1, further comprising:

a pair of conveyor belt rollers around which said conveyor belt is routed such that said conveyor belt comprises an outer run section, disposed remote from said front surface of said housing and said camera view port, and an inner run section disposed adjacent to said front surface of said housing and said camera view port.

5. The system as set forth in claim 4, wherein:

said housing has a predetermined longitudinal extent; and said pair of conveyor belt rollers are disposed at longitudinal extremes of said housing such that no conveyor belt components, other than said inner run section of said conveyor belt, are disposed in contact with said front surface of said housing and said camera view port whereby said inner run section of said conveyor belt can be conveyed across said front surface of said housing upon said air bearing layer in a substantially frictionless manner.

6. The system as set forth in claim 1, wherein:

said inner run section of said conveyor belt has a substantially planar configuration defining a conveyance plane for the plurality of mail articles; and said front surface of said housing has a substantially curvilinear configuration such that a first upstream end portion of said front surface of said housing diverges away from said conveyance plane of said inner run section of said conveyor belt and thereby defines therewith an entrance slot within which air discharged from said air plenum means defined within said housing causes the plurality of mail articles to be aerodynamically lifted into engagement with said inner run section of said conveyor belt, while a second downstream end portion of said front surface of said housing likewise diverges away from said conveyance plane of said inner run section of said conveyor belt and thereby defines therewith an exit slot within which air discharged from said air plenum means defined within said housing causes the plurality of mail articles to experience aerodynamic lift so as to thereby be maintained in engagement with said inner run section of said conveyor belt.

7. The system as set forth in claim 1, wherein:

said housing has a predetermined vertical extent; and said air plenum means comprises at least one apertured strip from which said air streams are generated, said at least one apertured strip having a predetermined vertical extent which is less than said predetermined vertical extent of said housing.

8. The system as set forth in claim 7, wherein:

said air streams generated from said at least one apertured strip of said air plenum means are characterized by means of an air pressure value which is substantially less than atmospheric pressure; and said at least one apertured strip, having said predetermined vertical extent which is less than said predetermined vertical extent of said housing, is located at a substantially central vertical location within said housing such that ambient atmospheric pressure zones are disposed above and below said sub-atmospheric air streams generated from said air plenum means so as to confine said sub-atmospheric air streams to predetermined locations for acting upon the plurality of mail articles.

9. The system as set forth in claim 4, wherein:

at least one of said conveyor belt rollers comprises a drive roller; and a servo drive motor is operatively connected to said at least one conveyor belt drive roller.

10. A mail article transportation and stabilization system, for use in conjunction with a camera-based scanning system whereby clear, accurate, and complete scanning, imaging, and reading of address information, contained upon a plurality of mail articles, being conveyed past the camera-based scanning system, can be achieved, comprising:

a housing comprising a front surface;

a camera fixedly disposed within said housing and comprising a camera view port defined within said front surface of said housing and across which a plurality of mail articles are to be serially conveyed in a longitudinal direction such that information contained upon the plurality of mail articles can be scanned, imaged, and read by said camera; and air plenum means defined within said housing for generating air streams outwardly from said housing, and toward the plurality of mail articles being conveyed, so as to define an air bearing layer upon which the plurality of mail articles, being conveyed in the longitudinal direction across said camera view port, can be conveyed in a substantially smooth, frictionless, and jitter-free manner across said camera view port of said camera such that said camera can scan, image, and read the information contained upon the plurality of mail articles in a clear, accurate, and complete manner.

11. The system as set forth in claim 10, wherein:

said camera comprises an optical character recognition (OCR) type camera.

12. The system as set forth in claim 10, wherein:

said camera comprises a bar code reader (BCR) type camera.

13. The system as set forth in claim 10, further comprising:

a conveyor belt, for conveying the plurality of mail articles across said camera view port, comprising an outer run section, disposed remote from said front surface of said housing and said camera view port, and an inner run section disposed adjacent to said front surface of said housing and said camera view port.

14. The system as set forth in claim 13, wherein:

only said inner run section of said conveyor belt, is disposed in contact with said front surface of said housing and said camera view port whereby said inner run section of said conveyor belt can be conveyed across said front surface of said housing upon said air bearing layer in a substantially frictionless manner.

15. The system as set forth in claim 10, wherein:

said inner run section of said conveyor belt has a substantially planar configuration defining a conveyance plane for the plurality of mail articles; and said front surface of said housing has a substantially curvilinear configuration such that a first upstream end portion of said front surface of said housing diverges away from said conveyance plane of said inner run section of said conveyor belt and thereby defines therewith an entrance slot within which air discharged from said air plenum means defined within said housing causes the plurality of mail articles to be aerodynamically lifted into engagement with said inner run section of said conveyor belt, while a second downstream end portion of said front surface of said housing likewise diverges away from said conveyance plane of said inner run section of said conveyor belt and thereby defines therewith an exit slot within which air discharged from said air plenum means defined within said housing causes the plurality of mail articles to experience aerodynamic lift so as to thereby be maintained in engagement with said inner run section of said conveyor belt.

16. The system as set forth in claim 10, wherein:

said housing has a predetermined vertical extent; and said air plenum means comprises at least one apertured strip from which said air streams are generated, said at least one apertured strip having a predetermined vertical extent which is less than said predetermined vertical extent of said housing.

17. The system as set forth in claim 16, wherein:

said air streams generated from said at least one apertured strip of said air plenum means are characterized by means of an air pressure value which is substantially less than atmospheric pressure; and said at least one apertured strip, having said predetermined vertical extent which is less than said predetermined vertical extent of said housing, is located at a substantially central vertical location within said housing such that ambient atmospheric pressure zones are disposed above and below said sub-atmospheric air streams generated from said air plenum means so as to confine said sub-atmospheric air streams to predetermined locations for acting upon the plurality of mail articles.

18. The system as set forth in claim 13, wherein:

said conveyor belt is routed around a pair of rollers at least one of which comprises a drive roller; and a servo drive motor is operatively connected to said at least one conveyor belt drive roller.

19. A method for transporting mail articles past a camerabased scanning system in order to obtain clear, accurate, and complete scanning, imaging, and reading of address information contained upon a plurality of mail articles, comprising the steps of:

fixedly disposing a camera within a housing such that a camera view port is defined within a front surface of said housing;

serially conveying a plurality of mail articles along a flow path which extends across said camera view port of said camera such that information contained upon the plurality of mail articles can be scanned, imaged, and read by said camera; and generating air streams outwardly from said housing, and toward the plurality of mail articles being conveyed across said camera view port of said camera, so as to define an air bearing layer upon which the plurality of mail articles, being conveyed across said camera view port of said camera, can be conveyed in a substantially smooth, frictionless, and jitter free manner across said camera view port of said camera such that said camera can scan, image, and read the information contained upon the plurality of mail articles in a clear, accurate, and complete manner.

20. The method as set forth in claim 19, comprising the additional step of:

providing said front surface of said housing with a substantially curvilinear configuration such that a first upstream end portion of said front surface of said housing diverges away from said article flow path and thereby defines therewith an entrance slot within which said generated air discharged from said housing causes the plurality of mail articles to be conveyed in an aerodynamically lifted manner along said article flow path so as to establish said substantially smooth, frictionless, and jitter-free conveyance of the plurality of mail articles along said article flow path, while a second downstream end portion of said front surface of said housing likewise diverges away from said article flow path and thereby defines therewith an exit slot within which said generated air discharged from said housing causes the plurality of mail articles to be conveyed in an aerodynamically lifted manner along said article flow path so as to maintain said substantially smooth, frictionless, and jitter-free conveyance of the plurality of mail articles along said article flow path.

* * * * *